US007108529B1

(12) United States Patent
Huang

(10) Patent No.: US 7,108,529 B1
(45) Date of Patent: Sep. 19, 2006

(54) AUDIO CONNECTOR

(76) Inventor: Huang-Chou Huang, No. 377, Fu-Teh First Rd., Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/150,156

(22) Filed: Jun. 13, 2005

(51) Int. Cl.
*H01R 29/00* (2006.01)

(52) U.S. Cl. ..... 439/188; 200/51.1

(58) Field of Classification Search ..... 439/188; 200/51.1

See application file for complete search history.

(56) References Cited

U.S. PATENT DOCUMENTS 5,893,767 A * 4/1999 Broschard, III ..... 439/188
6,062,885 A * 5/2000 White ..... 439/188
6,290,544 B1 * 9/2001 Gong et al. ..... 439/651
6,540,535 B1 * 4/2003 Zhu et al. ..... 439/188
6,551,127 B1 * 4/2003 Li et al. ..... 439/488
6,575,793 B1 * 6/2003 Li et al. ..... 439/668
6,690,801 B1 * 2/2004 Yeh ..... 381/77
6,923,687 B1 * 8/2005 Wang ..... 439/668

* cited by examiner

*Primary Examiner*—Tulsidas C. Patel
*Assistant Examiner*—Valdimir Imas
(74) *Attorney, Agent, or Firm*—Bacon & Thomas PLLC

(57) ABSTRACT

An audio connector has an insulated case, an inner and outer contact and a slide. The insulated case has a central socket and second and first inner recesses that communicate with the central socket. The second inner recess has a guide channel. The inner contact is mounted in the first inner recess and selectively protrudes into the central socket. The outer contact is mounted in the second inner recess, and has an outer resilient contact, a resilient switch contact and a stationary switch contact. The outer resilient contact selectively protrudes into the central socket. The resilient switch contact has a distal end that aligns with the guide channel. The slide is mounted movably in the guide channel and is pressed into the central socket by the resilient switch contact. When a jack is inserted into the central socket, the slide keeps the jack from damaging the outer resilient contact.

4 Claims, 4 Drawing Sheets

AUDIO CONNECTOR

BACKGROUND OF THE INVENTION

1. Field of the Invention

The present invention relates to a connector, especially to an audio connector.

2. Description of the Prior Arts

Electronic appliances that can generate sound such as televisions, hi-fi equipment, stereo amplifiers, etc. use audio connectors. The audio connector connects a jack of an earphone or a loud speaker to the circuit in the electronic appliance. The audio signal is transmitted from the circuit in the electronic appliance through the audio connector and the jack to the earphone or the loud speaker to generate sound.

With reference to FIG. 4, the conventional audio connector comprises an insulated case (30), an inner stationary contact (32), an inner resilient contact (33), an outer resilient contact (35), an outer resilient switch contact (36) and an outer stationary contact (34). The insulated case (30) has a central socket (31), a first inner recess and a second inner recess. The first inner stationary contact (32) is mounted in the first inner recess adjacent to the central socket (31). The first inner resilient contact (33) is mounted in the first inner recess and has a distal end and a protruding contact (331). The distal end makes contact with the first inner stationary contact (32) when the jack (40) is removed from the socket (31). The protruding contact (331) extends into the central socket (31) when the jack (40) is removed from the socket (31) and is pushed into the first inner recess and makes contact with the jack (40) when the jack (40) is seated in the socket (31). The outer resilient contact (35) is mounted in the second inner recess adjacent to the central socket (31) and has a distal end selectively extending into the central socket (31). The outer resilient switch contact (36) is mounted in the second inner recess and has an insulated protrusion (361) pushed by the outer resilient contact (35) when the jack (40) is seated in the socket (31). However, misalignment of the outer resilient contact (35) or the jack (40) in the socket (31) may cause the jack (40) to bend the outer resilient contact (35) and cause the audio connector to malfunction. The second outer stationary contact (34) is mounted in the second inner recess between the outer resilient contact (35) and the outer resilient switch contact (36) and has a distal end. The distal end connects to the outer resilient switch contact (36) when the jack (40) is removed from the socket (31).

To overcome the shortcomings, the present invention provides an improved audio connector to mitigate or obviate the aforementioned problems.

SUMMARY OF THE INVENTION

The main objective of the present invention is to provide an audio connector that is not easily damaged. The audio connector has an insulated case, and inner and outer contact and a slide. The insulated case has a central socket and second and first inner recesses that communicate with the central socket. The second inner recess has a guide channel. The inner contact is mounted in the first inner recess and selectively protrudes into the central socket. The outer contact is mounted in the second inner recess and has an outer resilient contact, a resilient switch contact and a stationary switch contact. The outer resilient contact selectively protrudes into the central socket. The resilient switch contact has a distal end that aligns with the guide channel. The slide is mounted movably in the guide channel and is pressed into the central socket by the resilient switch contact. When a jack is inserted into the central socket, the slide keeps the jack from damaging the outer resilient contact.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
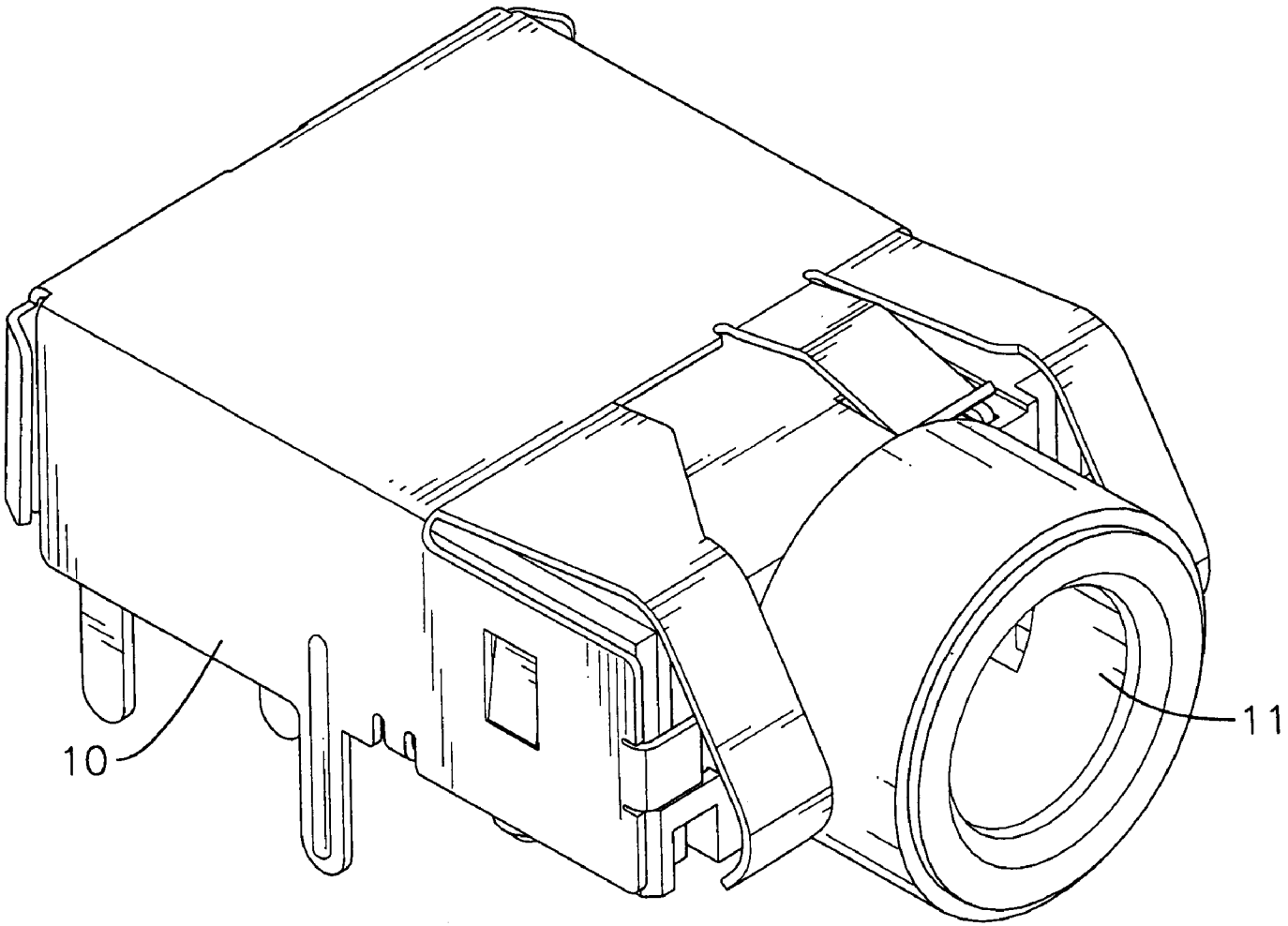
FIG. 1 is a perspective view of an audio connector in accordance with the present invention.
Figure 2:
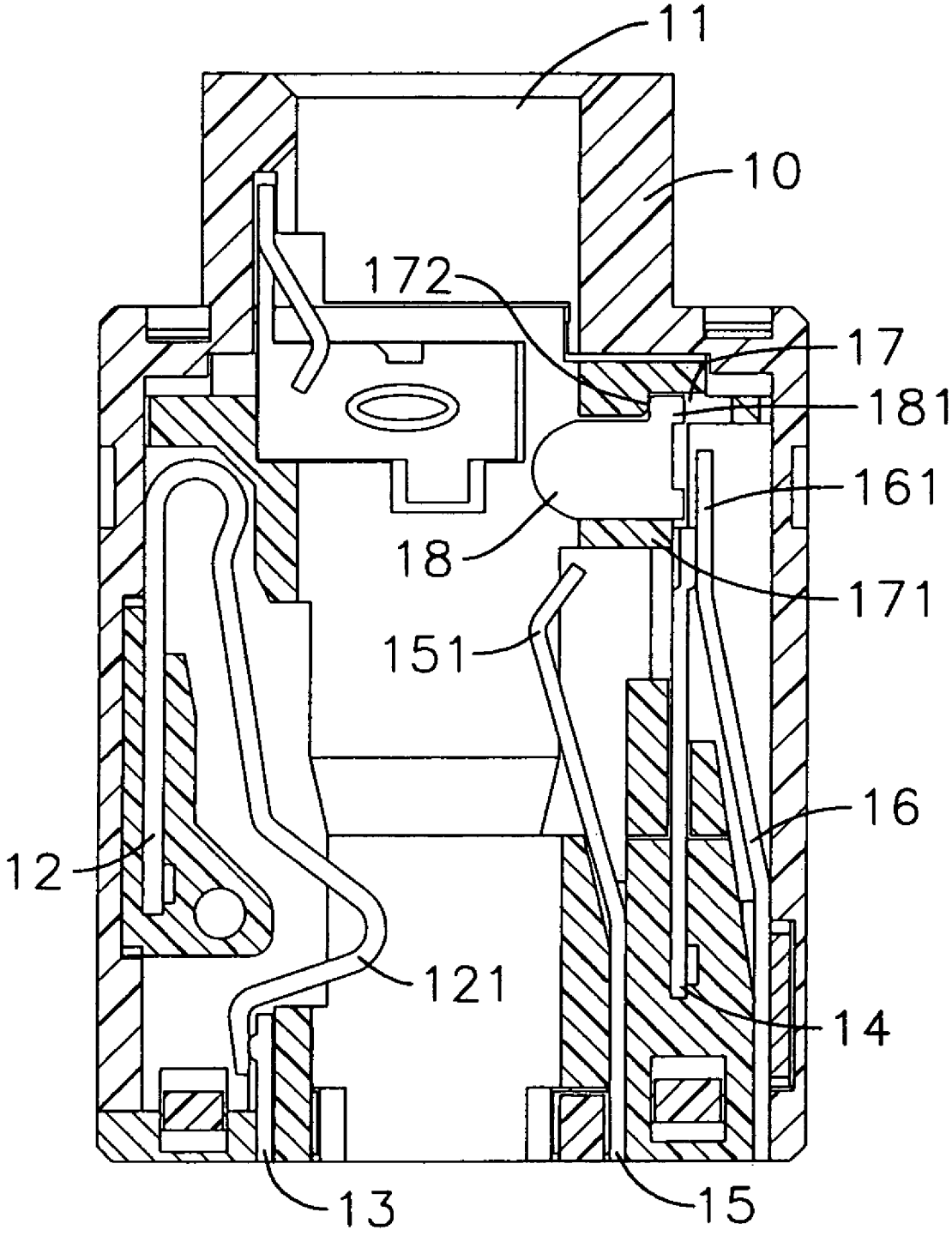
FIG. 2 is a side view in partial section of the audio connector in FIG. 1.

With reference to FIGS. 1 and 2, an audio connector in accordance with the present invention comprises an insulated case (10), an inner stationary contact (13), an inner resilient contact (12), an outer resilient contact (15), a resilient switch contact (16), a stationary switch contact (14) and a slide (18).

Figure 3:
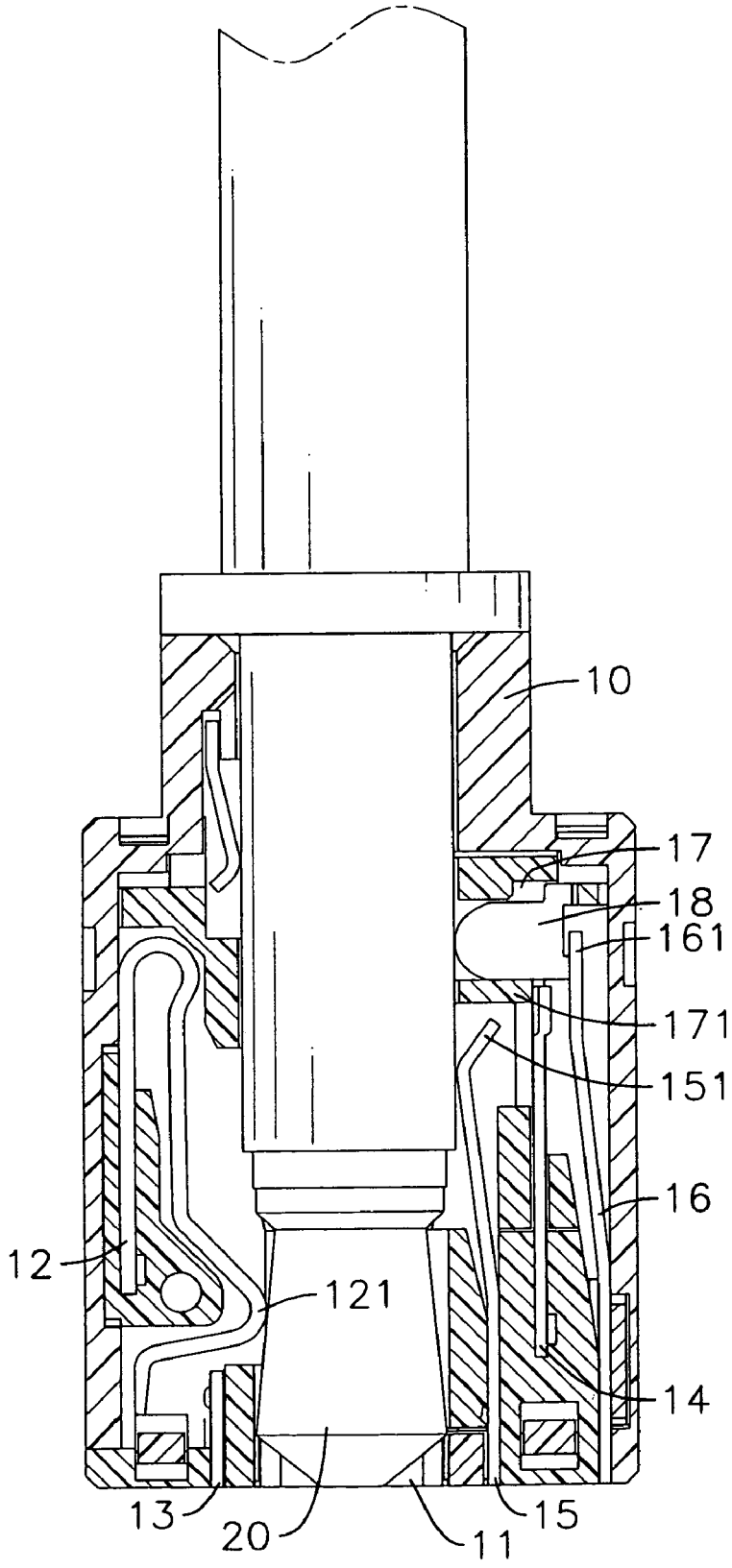
FIG. 3 is an operational side view in partial section of the audio connector in FIG. 1 with a jack.
Figure 4:
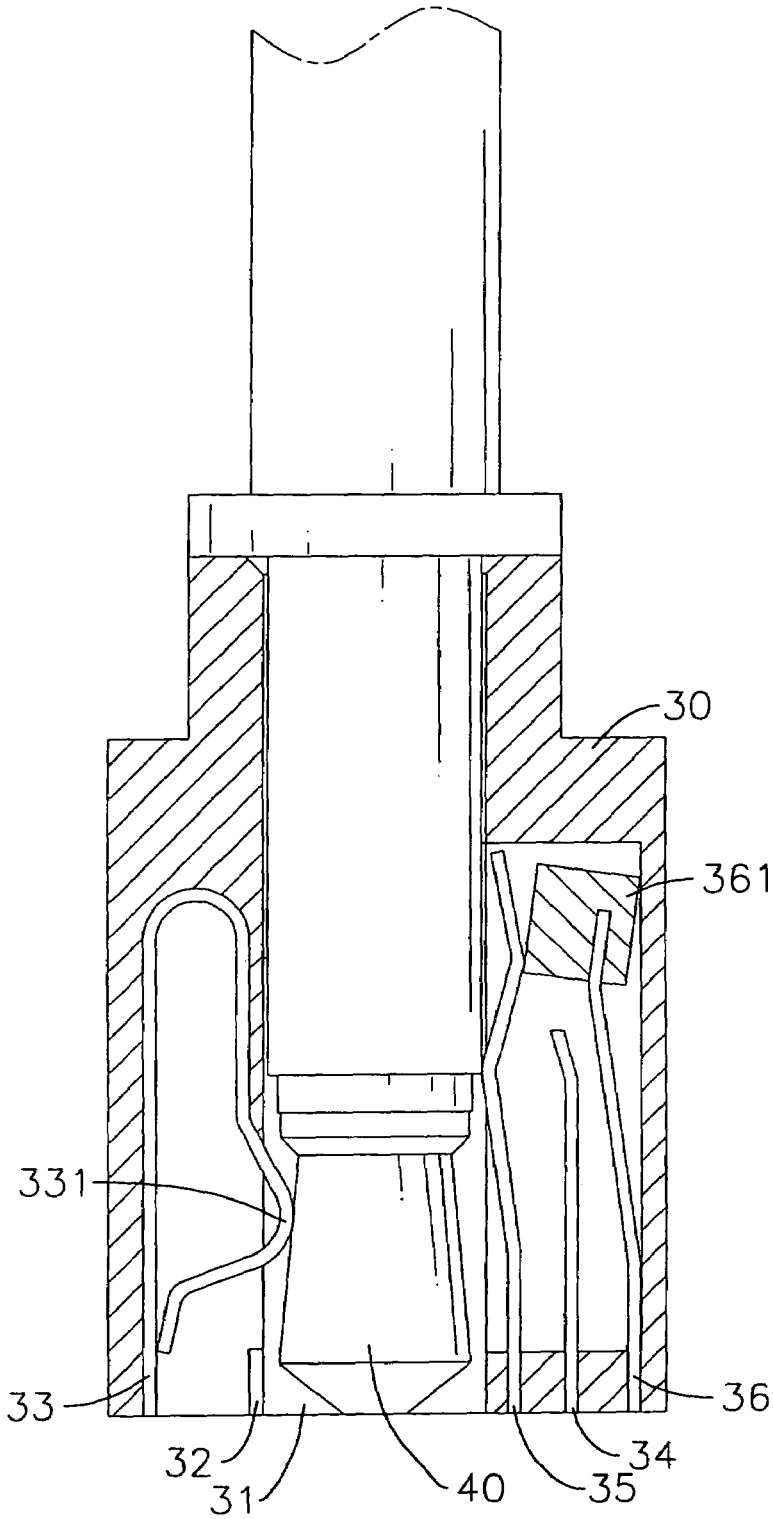
FIG. 4 PRIOR ART
FIG. 4 is an operational side view in partial section of an audio connector in accordance with the prior art with a jack seated in the audio connector.

The insulated case (10) has an outer end, an inner end, a central socket (11), a first inner recess and a second inner recess. With further reference to FIG. 3, the central socket (ii) is formed through the insulated case (10) to accommodate a jack (20) to be seated in the audio connector. The first inner recess is formed in the insulated case (10) at the inner end, communicates with the central socket (11) and has an inner end. The second inner recess is formed in the insulated case (10) at the inner end, communicates with the socket (11) and has an inner end, an outer end and a guide channel (17). The guide channel (17) is formed near the outer end of the second inner recess, communicates with the central socket (11) and has an optional shoulder (172).

The inner stationary contact (13) is mounted in the first inner recess near the inner end.

The first inner resilient contact (12) is mounted in the first inner recess and has a distal end and a protruding contact (121). The distal end makes electrical contact with the inner stationary contact (13) when the jack (20) is not in the central socket (11). The protruding contact (121) is formed near the distal end, protrudes into the central socket (11) when the jack (20) is not in the central socket (11) and is pushed into the first inner recess by and makes electrical contact with the jack (20) when the jack (20) is seated in the central socket (11).

The outer resilient contact (15) is mounted in the second inner recess and has a distal end (151). The distal end (151) protrudes into the central socket (11) when the jack (20) is not in the central socket (11) and is pushed into the second inner recess by and makes electrical contact with the jack (20) when the jack (20) is seated in the central socket (11).

The resilient switch contact (16) is mounted in the second inner recess and has a distal end (161). The distal end corresponds to and aligns with the guide channel (17).

The second stationary switch contact (14) is mounted in the second inner recess between the outer resilient contact (15) and the resilient switch contact (16) and makes electrical contact with the resilient switch contact (16) when the jack (20) is seated in the central socket (11).

The slide (18) is mounted movably in the guide channel (17), is pressed toward the central socket (11) by the resilient switch contact (16), extends into the central socket (11) when the jack (20) is not in the central socket (11), presses the distal end (161) of the resilient switch contact (16) to disconnect the resilient switch contact (16) from the stationary switch contact (14) when the jack (20) is seated in the central socket (11) and has an optional circular head and an optional transverse protrusion (181). Furthermore, the slide (18) presses against the jack (20) to keep the jack (20) from engaging and damaging the distal end (151) of the outer resilient contact (15). The circular head selectively extends into the central socket (11) and abuts the jack (20). The transverse protrusion (181) is formed on the slide (18) and corresponds to and selectively abuts the shoulder (172) in the guide channel (17).

With reference to FIG. 3, the jack (20) is inserted into the central socket (11) and pushes the slide (18) to press the distal end (161) of the resilient switch contact (16) to disconnect the second stationary switch contact (14). The slide (18) presses against the jack (20) to insert into the central socket (11) in a proper angle. Then the jack (20) pushes the distal end (151) of the outer resilient contact (15) and the protruding contact (121) of the first inner resilient contact (12) in the proper angle to leave the central socket (11) and will not easily damage the outer resilient contact (15). The protruding contact (121) of the first inner resilient contact (12) and the distal end (151) of the outer resilient contact (15) connect to the jack (20), and the sound signal can be transmitted to the jack (20).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An audio connector comprising an insulated case having an outer end;

an inner end;

a central socket formed through the insulated case;

a first inner recess formed in the insulated case at the inner end, communicating with the central socket and having an inner end; and a second inner recess formed in the insulated case at the inner end, communicating with the central socket and having an inner end;

an outer end; and a guide channel formed near the outer end and communicating with the central socket;

an inner stationary contact mounted in the first inner recess near the inner end;

an first inner resilient contact mounted in the first inner recess and having a distal end making electrical contact with the inner stationary contact; and a protruding contact formed near the distal end, protruding into the central socket and pushed into the first inner recess by and adapted for making electrical contact with a jack when the jack is seated in the central socket;

an outer resilient contact mounted in the second inner recess and having a distal end protruding into the central socket to be pushed into the second inner recess by and to make electrical contact with the jack when the jack is seated in the central socket;

a resilient switch contact mounted in the second inner recess and having a distal end corresponding to and aligning with the guide channel;

a second stationary switch contact mounted in the second inner recess between the outer resilient contact and the resilient switch contact to make contact with the resilient switch contact when the jack is seated in the central socket; and a slide mounted movably in the guide channel, pressed toward the central socket by the resilient switch contact, extending into the central socket and adapted for pressing the distal end of the resilient switch contact to disconnect the resilient switch contact from the stationary switch contact when the jack is seated in the central socket, wherein the slide has a circular head selectively extending into the central socket.

2. The audio connector as claimed in claim 1, wherein the guide channel has a shoulder; and the slide has a transverse protrusion formed on the slide and corresponding to and selectively abutting the shoulder of the guide channel.

3. The audio connectors claimed in claim 1, wherein the guide channel has a shoulder; and the slide has a transverse protrusion formed on the slide and corresponding to and selectively abutting the shoulder of the guide channel.

4. An audio connector comprising an insulated case having an outer end;

an inner end;

a central socket formed through the insulated case;

a first inner recess formed in the insulated case at the inner end, communicating with the central socket and having an inner end; and a second inner recess formed in the insulated case at the inner end, communicating with the central socket and having an inner end;

an outer end; and a guide channel formed near the outer end and communicating with the central socket;

an inner stationary contact mounted in the first inner recess near the inner end;

an first inner resilient contact mounted in the first inner recess and having a distal end making electrical contact with the inner stationary contact; and a protruding contact formed near the distal end, protruding into the central socket and pushed into the first inner recess by and adapted for making electrical contact with a jack when the jack is seated in the central socket;

an outer resilient contact mounted in the second inner recess and having a distal end protruding into the central socket to be pushed into the second inner recess by and to make electrical contact with the jack when the jack is seated in the central socket;

a resilient switch contact mounted in the second inner recess and having a distal end corresponding to and aligning with the guide channel;

a second stationary switch contact mounted in the second inner recess between the outer resilient contact and the resilient switch contact to make contact with the resilient switch contact when the jack is seated in the central socket; and a slide mounted movably in the guide channel, pressed toward the central socket by the resilient switch contact, extending into the central socket and adapted for pressing the distal end of the resilient switch contact to disconnect the resilient switch contact from the stationary switch contact when the jack is seated in the central socket; wherein the guide channel has a shoulder; and the slide has a transverse protrusion formed on the slide and corresponding to and selectively abutting the shoulder of the guide channel.

* * * * *